US005908251A

United States Patent [19]

Buckby

[11] Patent Number: 5,908,251

[45] Date of Patent: Jun. 1, 1999

[54] METHOD OF PRINTING

[75] Inventor: Steven John Buckby, Nottingham, United Kingdom

[73] Assignee: Markem Technologies Ltd., Nottingham, United Kingdom

[21] Appl. No.: 08/927,678

[22] Filed: Sep. 10, 1997

Related U.S. Application Data

[63] Continuation of application No. 08/384,851, Feb. 7, 1995, abandoned.

[30] Foreign Application Priority Data

May 20, 1994 [GB] United Kingdom ..... 9410273
Sep. 27, 1994 [GB] United Kingdom ..... 9419469

[51] Int. Cl.[6] ..... B41J 33/54

[52] U.S. Cl. ..... 400/231; 400/120.05; 400/232

[58] Field of Search ..... 400/120.01, 120.05, 400/225, 219, 223, 226, 231, 232

[56] References Cited

U.S. PATENT DOCUMENTS

| | | | |
|---|---|---|---|
| 4,033,444 | 7/1977 | Beery | 400/124.07 |
| 4,189,636 | 2/1980 | Satoh | 235/92 MP |
| 4,422,376 | 12/1983 | Teraoka | 101/69 |
| 4,453,166 | 6/1984 | Enoto | 346/1.1 |
| 4,558,963 | 12/1985 | Applegate et al. | 400/225 |
| 4,563,692 | 1/1986 | Negita | 346/76 PH |
| 4,590,486 | 5/1986 | Yana | 346/76 PH |
| 4,591,878 | 5/1986 | Sasaki et al. | 346/76 PH |
| 4,595,935 | 6/1986 | Brooks et al. | 346/76 PH |
| 4,606,661 | 8/1986 | Aldrich et al. | 400/213 |
| 4,610,555 | 9/1986 | DiLuco | 400/243 |
| 4,611,938 | 9/1986 | Rettke et al. | 400/212 |
| 4,625,216 | 11/1986 | Brooks et al. | 346/76 PH |
| 4,636,810 | 1/1987 | Asakura et al. | 346/76 PH |
| 4,647,238 | 3/1987 | Okamoto et al. | 400/225 |
| 4,650,356 | 3/1987 | Purcell et al. | 400/208 |
| 4,688,051 | 8/1987 | Kawakami et al. | 346/76 PH |

(List continued on next page.)

FOREIGN PATENT DOCUMENTS

| | | | |
|---|---|---|---|
| 0 262 506 | 4/1988 | European Pat. Off. | 400/53 |
| 0 581 403 | 2/1994 | European Pat. Off. | 400/120.01 |
| 0 635 368 | 1/1995 | European Pat. Off. | 400/240 |
| 36 08 360 | 9/1987 | Germany | 400/225 |
| 59-207276 | 11/1984 | Japan | 400/225 |
| 60-52386 | 3/1985 | Japan | 400/225 |
| 61-132366 | 6/1986 | Japan | 400/120 HE |
| 62-19479 | 1/1987 | Japan | 400/225 |
| 62-246773 | 10/1987 | Japan | 400/237 |
| 63-182172 | 2/1988 | Japan | 400/237 |
| 3-205174 | 9/1991 | Japan | 400/225 |
| 6-8597 | 1/1994 | Japan | 400/240 |
| 60-08597 | 1/1994 | Japan | 400/237 |
| 2 175 253 | 11/1986 | United Kingdom | 400/225 |
| 2 234 710 | 2/1991 | United Kingdom | 400/225 |
| 2 289 441 | 11/1995 | United Kingdom | 400/225 |
| 89/10264 | 11/1989 | WIPO | 400/225 |

OTHER PUBLICATIONS

IBM Technical Disclosure Bulletin, "Ribbon Saving Technique for APA Printers", 31:10, 1989.

IBM Technical Disclosure Bulletin, "Ribbon Saver Drive Apparatus", 29:3, 1986.

IBM Technical Disclosure Bulletin, "Ribbon Conservation Resistive Ribbon Inks", 28:12, 1986.

IBM Technical Disclosure Bulletin, "Thermal Print Head Having Improved Print Quality and Efficiency", 27:7b, 1984.

IBM Technical Disclosure Bulletin, "High Yield and Low Cost Ribbon Feed", 212:9, 1979.

"Coding and Labelling: no shortage of new ideas", Food Manufacture, Dec. 1992.

*Primary Examiner*—John Hilten
*Attorney, Agent, or Firm*—Fish & Richardson P.C.

[57] ABSTRACT

A method of printing that utilizes a printing head having a plurality of printing elements each of which is operable to transfer a pixel print medium from a carrier on to an adjacent substrate.

36 Claims, 4 Drawing Sheets

U.S. PATENT DOCUMENTS 4,712,115 12/1987 Tatsumi et al. ..... 346/76 PH
4,740,092 4/1988 Applegate et al. ..... 400/53
4,760,405 7/1988 Nagira et al. ..... 346/1.1
4,763,137 8/1988 Damon et al. ..... 346/76 PH
4,789,260 12/1988 Kobayashi et al. ..... 400/697.1
4,805,053 2/1989 Yamanaka et al. ..... 360/72.3
4,816,843 3/1989 Sasaki ..... 346/76 PH
4,820,551 4/1989 Krauter et al. ..... 427/146
4,893,951 1/1990 Iwatani et al. ..... 400/225
4,899,170 2/1990 Izumi ..... 346/76 PH
4,921,363 5/1990 Nishihara et al. ..... 400/208
4,947,188 8/1990 Nozaki ..... 346/76 PH
4,953,995 9/1990 Sims et al. ..... 400/555
4,979,058 12/1990 Koga ..... 360/137
5,017,028 5/1991 Harding ..... 400/120
5,030,021 7/1991 Kamiya ..... 400/124
5,039,241 8/1991 Yamaji ..... 400/216.2
5,050,031 9/1991 Weiley ..... 360/137
5,064,302 11/1991 Tanuma et al. ..... 400/54
5,072,237 12/1991 Tokaoka ..... 346/76 PH
5,087,137 2/1992 Burnard et al. ..... 400/249
5,130,879 7/1992 Weiley ..... 360/132
5,135,319 8/1992 Kobayashi et al. ..... 400/208
5,137,378 8/1992 Satoh ..... 400/120
5,157,761 10/1992 Hawkes ..... 395/107
5,241,904 9/1993 Kobayashi et al. ..... 101/93.04
5,243,485 9/1993 Weiley ..... 360/132
5,357,270 10/1994 Herbert ..... 346/76 PH
5,366,307 11/1994 McGourty et al. ..... 400/708
5,372,439 12/1994 Poole et al. ..... 400/232
5,380,108 1/1995 Fukahori et al. ..... 400/247
5,393,149 2/1995 Iima ..... 400/208
5,426,451 6/1995 Brock et al. ..... 347/199
5,482,386 1/1996 Thiel et al. ..... 400/120.12
5,491,503 2/1996 Fuwa ..... 347/171
5,546,114 8/1996 Tait et al. ..... 347/212
5,567,066 10/1996 Paranjpe ..... 400/249
5,649,774 7/1997 Harding et al. ..... 400/225
5,657,066 8/1997 Adams et al. ..... 347/198

METHOD OF PRINTING

This is a continuation of U.S. application Ser. No. 08/384,851, filed Feb. 7, 1995, now abandoned.

BACKGROUND TO THE INVENTION

This invention relates to a method of printing.

In pixel based printing systems such as dot matrix ribbon printing, or thermal transfer printing which utilises a carrier or web which carries print medium such as ink, (known in thermal printing, as ribbon or foil), one major expense for a user is the cost of the ribbon or foil.

SUMMARY OF THE INVENTION

According to the invention we provide a method of printing utilising a printing head having a plurality of printing elements each of which is operable to transfer a pixel of print medium from a carrier onto an adjacent substrate, the method comprising the steps of causing relative movement between the substrate and carrier, and the print head, such that the print head moves relative to an area of the carrier from a start position to an end position whilst utilising some or all of the printing elements to transfer a first set of pixels of print medium from the area of the carrier onto the substrate, causing relative movement between the print head and the carrier to replace the print head at the start position, causing relative movement between the carrier and the substrate such that fresh substrate is presented adjacent to the area of the carrier, and causing relative movement between the fresh substrate and the carrier, and the print head, such that the print head moves relative to the area of the carrier again from the start position to the end position whilst utilising some or all of the printing elements, to transfer a second set of pixels of print medium from the area of the carrier, onto the adjacent fresh substrate.

In all pixel based printing systems, print density is determined by dot resolution. The invention offers a way for a user to save the cost of thermal printing ribbon or foil, or other carrier and print medium where the relatively high density print which can be obtained by at least the higher resolution dot based printing systems, is not required.

By "fresh substrate" we mean an entirely fresh substrate, such as a different label, or a further part of the same substrate, onto which pixels of print medium have not previously been transferred from the carrier.

After each printing operation the printing head may be moved e.g. laterally, away from the carrier and substrate, and held a short distance away from the carrier whilst the carrier and/or substrate are moved in preparation for the next printing operation, and then moved e.g. laterally, back towards the carrier and substrate.

If desired, during printing, during the first relative movement between the substrate and the carrier, and the print head, a first set only of the printing elements is employed to transfer the first set of pixels of print medium onto the substrate. Likewise, during printing, during the relative movement between the fresh substrate and carrier, and the print head, a second set of printing elements is employed to transfer the second set of pixels of print medium onto the substrate.

Thus for example, two separate substrates or separate areas of substrate can be printed for example, with the same information, but the apparatus only consumes one area of ribbon or foil.

Particularly where the printing head includes a high density of printing elements, the method may be repeated several times for the same area of carrier, with each relative movement between substrate and carrier, and the print head, utilising different printing elements to transfer different pixels of print medium onto substrate. During a final printing operation on a particular area of the carrier all, or substantially all, the printing elements may be used thus ensuring that, even if there is some misalignment between the printing elements and the remaining pixels of print medium, the remaining pixels of print medium will be transferred.

Alternatively, during printing, during the first relative movement between the substrate and carrier, and the print head from the start position to the end position, printing elements are utilised to transfer pixels of print medium from the area of the carrier onto the substrate, and during printing, during the relative movement between fresh substrate and carrier, and the print head, printing elements are utilised to transfer pixels of print medium from the area of the carrier onto the fresh substrate such that the pixels of print medium are transferred from different pixel positions of the carrier to the pixel positions from which the print medium was transferred during the previous relative movement between the substrate and carrier, and the print head.

In this case, during a final printing operation on a particular area of the carrier, the printing elements may be used such that printing elements are utilised in pixel positions at least partially coincidental with pixel positions of the carrier from which print medium was transferred in a previous printing operation.

In one embodiment, the relative movement between the substrate and carrier, and the print head, is produced by movement of the print head whilst the substrate and carrier are held stationary.

In another embodiment, the relative movement between the substrate and carrier, and the print head, is produced by movement of the substrate and carrier whilst the print head is held stationary.

The invention is particularly but not exclusively applicable to thermal transfer printing, where the print medium comprises ink carried on a carrier comprising a continuous backing web, and the printing elements are energised to produce heat to transfer pixels of ink from the carrier onto a substrate.

In such an application, there are typically at least six, commonly eight or twelve or more printing elements per millimeter of printing head, arranged in a single line array. The printing elements may, however, be arranged in a multiple line, or other non-single line array.

However the invention may be applied to any other dot based printing system such as a (lot matrix printer which utilises a woven ribbon as a carrier for ink and where printing elements are arranged in an array.

According to a second aspect of the invention we provide a printing apparatus comprising a print head operable to transfer pixels of print medium from a carrier onto an adjacent substrate, means to maintain the print head during printing, stationary, and to move the carrier and substrate in a first direction past the print head from a start position to an end of print position over an area of the carrier and means to cause the carrier, after a first printing operation, to move relative to the print head in a second direction generally opposite to the first direction and to present fresh substrate adjacent to the print head so that in a subsequent printing operation, the fresh substrate is moved with carrier, in the first direction past the printing head.

BRIEF DESCRIPTION OF THE DRAWINGS

The invention will now be described with reference to the accompanying drawings in which.

DESCRIPTION OF THE PREFERRED EMBODIMENTS

Figure 1:
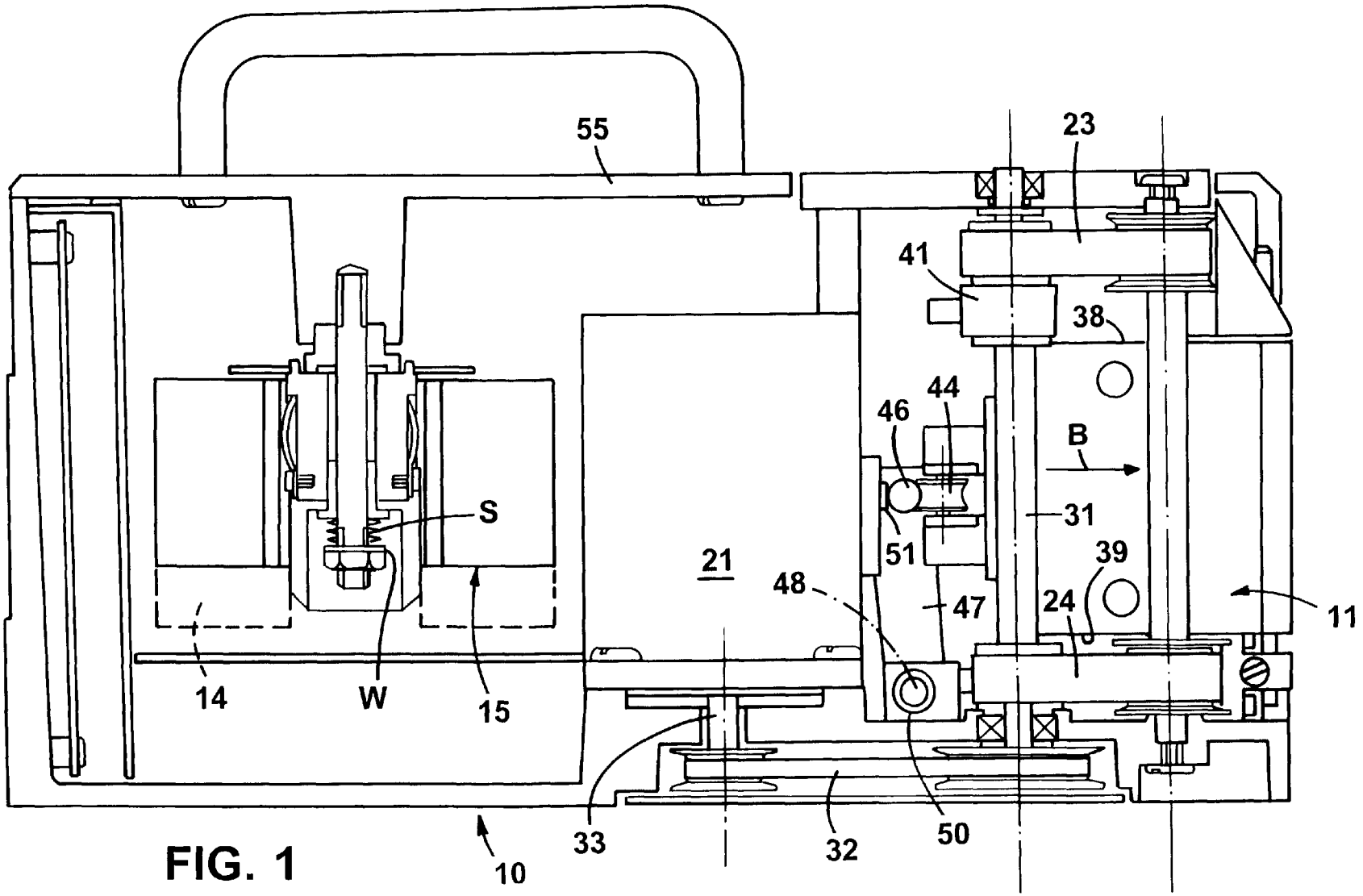
FIG. 1 is a side illustrative view of a printing apparatus which may be operated by a method in accordance with the invention, without a print medium carrying carrier being shown, for clarity.
Figure 2:
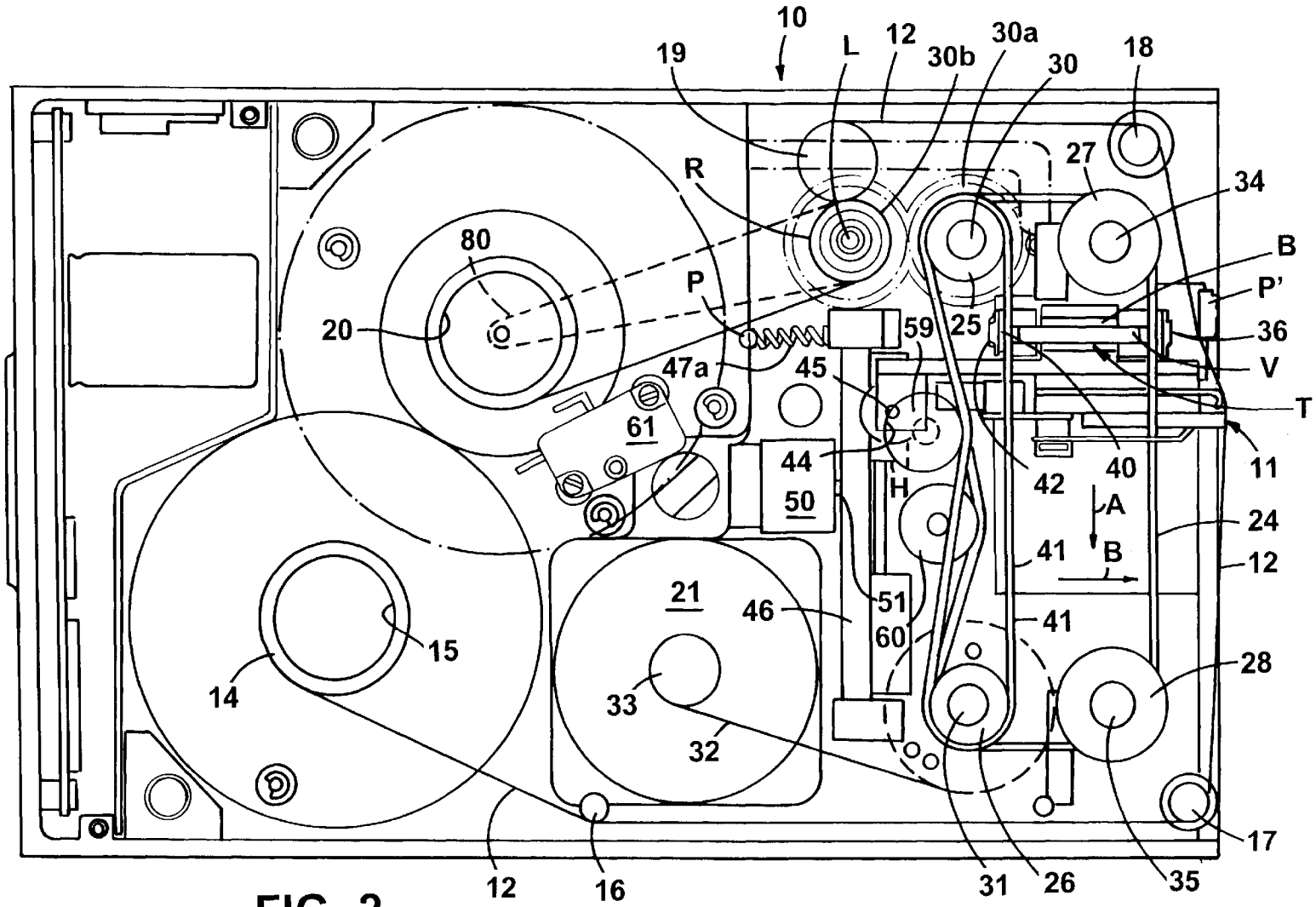
FIG. 2 is a top plan view of the printing apparatus of FIG. 1, showing the print medium carrying carrier.
Figure 3:
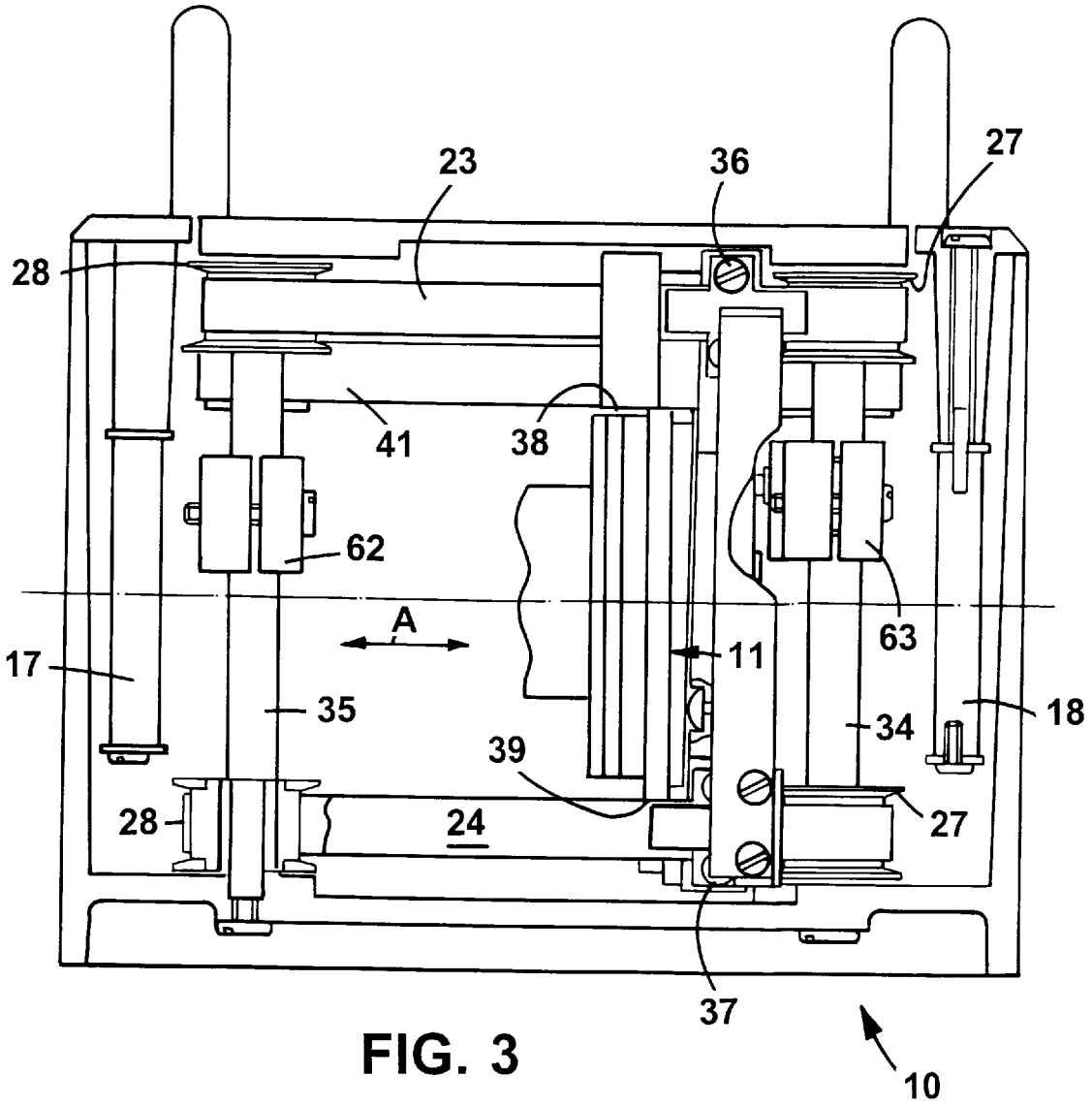
FIG. 3 is a front illustrative view of the printing apparatus of FIG. 1 again without the print medium carrying carrier for clarity.

Referring to FIGS. 1 to 3, there is shown a printing apparatus 10 comprising a print head assembly 11 which mounts a plurality of individually energisable thermal printing elements, preferably provided on an edge of the print head assembly 11, in a single line array. The print head assembly 11 is movable relative to carrier, being a web 12 which carries print medium comprising ink, whilst the thermal printing elements are individually selectively energised under computer control, wherein the elements will become hot, thus to cause pixels of ink to be removed from the web 12 and deposited onto a substrate (not shown) to the right hand side of the apparatus 10 as seen in FIG. 1. The substrate may for example be a label which is subsequently applied to an article, or packaging material, or may be the article itself, which substrate moves past the printing apparatus 10 and is temporarily halted at the printing apparatus 10 whilst printing thereon is effected.

In this way, information can be printed, in ink, on the substrate.

The information usually is, one or more alpha-numeric characters, to indicate for example, a sell-by date. The or each such character is defined by a plurality of pixels of print medium i.e. ink, transferred from the web 12 or other carrier by the energised printing elements of the printing head assembly 11 as the print head assembly 11 is moved relative to the carrier and substrate.

The web 12 carrying the ink is provided on a supply spool 14 carried on a hub 15, the web 12 passing around a web guide path comprising idler rollers 16,17,18, around a further roller 19 between the roller 19 and a drive roller R and then on to a take up spool mounted on a hub 20. The drive roller R and take up spool are driven, is hereinafter explained, from a motive means 21 which is in this example, a stepper motor.

The hub 15 and hence spool 14 provides some resistance to web 12 being paid out therefrom, this being provided by a friction means being a clutch material W and a spring S configured as is well known in the art. The take up spool is also mounted on a hub 20 having a similar friction means.

The print head assembly 11 is driven for movement relative to the web 12 by the motor 21 via a transmission. The transmission comprises a pair of generally parallel spaced apart flexible drive members comprising belts 23,24, which are entrained respectively about pairs of rollers 25,26, and rollers 27,28.

The first pair of rollers 25,26, are mounted on respective generally parallel and vertical drive shafts 30,31, with shaft 31 being driven via a belt 32 or chain drive or otherwise as required, from an output shaft 33 of the stepper motor 21.

The second pair of rollers 27,28, are each mounted on respective generally parallel and vertical shafts 34,35, via bearings so that the rollers 27,28, are free to rotate relative to their respective shafts 34,35.

Drive shaft 30 has secured to it, a gear 30*a* which meshes with a gear 30*b* on a shaft L on which roller R is provided.

As can be seen from FIG. 1, the print head assembly 11 is of generally rectangular configuration, and is secured to a mounting structure T which is clamped at screws 36,37, (see FIG. 3) to the belts 23,24. Upon operation of the motor 21 drive is transmitted from the drive shaft 33 of the motor to each of the belts 23,24, via the shaft 31, and hence the print head assembly 11 is caused to move either in the direction indicated by arrow A, relative to the web 12, or an opposite direction depending upon the sense of rotation of the output shaft 33 of the motor 21.

The structure T comprises a slider element V and a bearing B which is fixed relative to the print head assembly 11 and is slidable relative to the slider element V. Hence the print head assembly 11 can slide in the direction of arrow B and in an opposite direction, relative to the slider element V.

The mounting structure T is also clamped at its rear edge 40 to a third belt 41 as shown at 42 in FIG. 2, the third belt 41 being driven in synchronism with belts 23,24, from shaft 31, but being entrained only about the shafts 31 and 30.

The print head assembly 11 also carries at its rear edge, a guide roller 44 which is rotatable about a generally vertical axis 45 transverse to the direction A of movement of the print head assembly 11 during printing. The roller 44 bears on a generally horizontal post 46 of generally circular cross section, the post being mounted via a lever arm 47 for rotation about a horizontal axis 48 generally parallel to but spaced from the post 46, on a bearing 50 which is fixed relative to a body of the printing assembly 10.

Hence as the print head assembly 11 moves from side to side, in the direction of arrow A or oppositely, the print head assembly 11 is guided for movement via the guide roller 44 and post 46.

A strong spring 47*a* is provided between the post 46 and a frame part P of the apparatus 10 to bias the post 46 about axis 48 away from the print head. assembly 11. The print head assembly 11 carries a hook formation H which engages with post 46 so that as the post 46 moves in the direction generally opposite to that of arrow B, the print head assembly 11 is moved with it, and slides relative to the mounting structure T.

The amount that the post 46 can be moved by the spring 47*a* is restricted by means of an air cylinder 50 which is positioned behind the post 46.

In the figures, the print head assembly 11 is shown in a start position spaced away from a substrate, but with the web 12 carrying the ink, entrained over an edge of the print head assembly 11 mounting the thermal printing elements.

To bring the print head assembly 11 towards the web 12 and substrate to effect printing, the print head assembly 11 is moved in a direction indicated by arrow B, i.e. laterally, which is transverse to the direction of movement of the print head assembly 11 during printing, as indicated by arrow A.

Movement of the post 46 and hence of the print head assembly 11 in direction B is achieved by means of the air cylinder 50 and its piston 51, which, when actuated, rotates the guide post 46 about axis 48, thus to urge the print head assembly 11 towards the substrate, against the restoring force of the spring 47*a*. The piston 51 is arranged to retain the print head assembly 11 in its extended position against the restoring force of the springs 47*a*, whilst the print head assembly 11 moves from the beginning, to end of printing positions in direction of arrow A, to effect printing on the substrate.

At the end of printing, when the print head assembly 11 is in its end of printing position, the piston 51 is deactuated and the print head assembly 11 is moved in an opposite direction to arrow B by the restoring force of the spring 47*a* away from the substrate and, by actuating the motor 21 in an opposite sense of rotation, the print head assembly 11 is moved back to the start position shown in the drawings in a direction opposite to the direction of arrow A.

The hub 20 of the take up spool carried by hub 20 is driven from the motor 21 via a drive belt 80 shown in dotted lines in FIG. 2, which is fixed to rotate with the drive roller R. Between drive roller R and the shaft L which is rotated by gear 30*b*, there is a mechanical one-way clutch which permits the shaft L to rotate relative to the roller R as the stepper motor 21 rotates in one sense of rotation (clockwise in FIG. 2) during a printing operation. Thus the web 12 and take-up spool 20 remain stationary during a printing operation as the extended print head 11 moves downwardly as seen in FIG. 2. A one-way clutch suitable for this purpose is well known in itself and is a purely mechanical unit.

Of course, when the stepper motor 21 is rotated in an opposite sense of rotation, in the absence of any other means, the one-way clutch would cause the drive roller R to rotate clockwise as seen in FIG. 2, and thus drive the web 12 which is entrained about it, as well as the take up spool 20, so that the web 12 advances as the print head assembly 11 is moved back to the start of print position indicated in the drawings.

To enable the apparatus 10 to operate in accordance with the present invention, there is provided a further clutch between the gear 30*b* and shaft L so that during the return movement of the printing head 11 to the start of print position, the shaft L and hence the drive roller R can be prevented from rotating with the gear 30*b*. Such a clutch preferably comprises an electrically operated clutch which is under the control of the computer control of the apparatus.

Further features of the printing apparatus are as follows.

In this embodiment described, the spools 14 and spool carried by hub 20 as well as the drive roller R (but not its shaft L) and idler rollers 19, 18 and 17 are carried by a cassette 55 which can be removed from the body of the printing apparatus 10 to facilitate replenishing the printing apparatus 10 with web 12.

The web guide path includes a peeler bar P' behind which the web 12 passes immediately after passing over the print head assembly 11, the bar P' being operable to ensure proper separation of ink deposited on the substrate, and remaining web 12.

The belt 41 is maintained under tension by means of a tensioning roller 59 and the belts 23,24, can also be kept under constant tension by tensioning rollers 60.

When the cassette 55 carrying the spools 14 and 20 is removed, a micro switch 61 which feeds power to the stepper motor 21 is tripped so that there is no risk of the mechanism of the printing apparatus 10 being actuated without the cassette 55 being in position.

In the event that the web feed spool 14 becomes empty, an electronic sensor carried by a clamp 62 past which the web 12 passes, will signal the lack of web 12 to an operator, and/or disable printing apparatus 10.

The amount of movement of the print head assembly 11 in a direction opposite to that of arrow A i.e: the return movement, is restricted by means of a microswitch carried on a clamp means 63 which senses the print head assembly 11 when returned to its start position, immediately to stop motor 21.

It will be appreciated that by virtue of the print head assembly 11 being mounted on the flexible belts 23,24, and 41 via the mounting structure T, the assembly 11 is able to float to a smaller degree about the central axis of post 46. The roller 44 mounted at the rear of the printing assembly 11 engages with the post 46 to restrict other movements.

Hence in the event that the substrate onto which print medium is to be transferred is not exactly at right angles to the array of printing elements mounted by the print head assembly 11, the assembly 11 can move slightly about the central axis of post 46 as the print head assembly 11 is moved towards the substrate by the actuator 50 to accommodate such slight misalignment.

Hence, improved quality of print can be achieved throughout the entire printing operation. In the absence of some means to accommodate misalignment of the substrate, quality of print would tend to suffer over at least some of the area of the substrate onto which information is printed.

The printing apparatus described above may be operated by a method in accordance with the first invention as follows.

In the apparatus described, the print head assembly 11 may comprise at least six, but possibly eight, twelve, or more energisable printing elements per millimeter width of the print head assembly 11, with all of the energisable print elements arranged in a single line array across the printing head assembly 11.

Rather than utilising all of the printing elements for printing, as the print head assembly 11 is traversed relative to the webs 12 and substrate, a first set only of the printing elements may be utilised on a first printing operation. For example, every alternate printing element may be utilised whilst the print head assembly 11 is traversed over or otherwise moves over an area of the web 12 from its start to end of print positions to transfer pixels of ink from the web 12 onto the substrate.

Hence an alpha-numeric character or a plurality of such characters may be printed on the substrate. However, as only some of the printing elements are utilised, the print density will obviously be less overall than if all the printing elements of the print head assembly 11 were used during printing. Whereas this might not be acceptable for printing machine-readable information such as a bar code, where the information printed is for example a sell-by date comprising a plurality of alpha-numeric characters, a human reader will have little difficulty in reading the information.

At that stage, rather than advancing the web 12, the print head assembly 11 is moved as hereinbefore described relative to the web 12 back to the start of print position, but the electronically operated clutch between the gear 30*b* and its shaft L is operated so as to isolate the roller R so that the web 12 is not advanced. The substrate may be advanced, or an entirely fresh substrate may be presented adjacent to the same area of the web 12 which was traversed by the print head assembly 11 immediately previously.

The print head assembly 11 may then be operated to traverse the same area of the web 12, but different printing elements are utilised during printing to transfer pixels of ink from the web 12 onto the substrate.

Thus only some of the printing elements are utilised the first time the print head assembly 11 traverses the area of the web 12, and only some, and different, printing elements are utilised the second time the print head assembly 11 traverses the same area of the web 12.

At this stage, when the print head assembly 11 is returned to the start of print position, the clutch between the gear 30*b* and its shaft L is operated to cause the roller R and the take-up spool 20 to rotate so that the web 12 is advanced.

The take up spool 20 may have a slipping clutch which permits differential movement between the spool 20 and the drive roller R as the spool 20 becomes filled with used web 12.

Thus the amount of web 12 utilised for printing will be reduced by half, in this example, assuming that the web 12 is advanced after the print head assembly 11 has relatively traversed the web 12 for a second time.

In arrangements where a large number of printing elements per millimeter are provided, it might be possible for the print head assembly 11 to traverse or otherwise move over the same area of the web 12 more than twice, but each traverse of the same area of the web 12 will utilise different printing elements with a consequent saving in web 12.

During second or other the final printing operation using a particular area of web 12 all of the printing elements may be used. This ensures that, even if there is some misalignment between the printing elements and the remaining pixels of ink on the web 12, sufficient of the remaining pixels of ink will be transferred to achieve satisfactory printing.

Where the print head assembly 11 traverses the same area of the web 12 more than twice, it will be appreciated that for each such traverse, fresh substrate, being either a fresh area of substrate, or an entirely different substrate, would need to be presented adjacent to that area of the web 12.

The apparatus described with reference to the drawings may alternately be operated by the method of the invention as follows.

During a first traverse or other movement of the print head assembly 11 relative to the web 12 between the start and end positions, each of the printing elements may be utilised to transfer pixels of print medium i.e. ink, from the web 12 onto the substrate. However the printing elements may only be operated for certain pixel positions (rows) between the start and end of printing positions.

Again the print density will be lower than if the printing elements were all actuated in all pixel positions, but again, where the information to be printed is intended for a human reader, the print density will in most instances be sufficient for the human reader to read the information.

Once the print head assembly 11 is returned to the start position (without the web 12 having been advanced) and traversed over or otherwise moved relative to the same area of the web 12 a second time, each of the printing elements may again be utilised, but by ensuring that each printing element is not operated when in the same pixel position that the printing element was previously operated during the first traverse of the print head 11 relative to the web 12, pixels of ink are transferred from different pixel positions of the web 12 to the pixel positions from which ink was transferred during the previous traverse of the print head assembly relative to that area of web 12.

Utilising this method, again the amount of web 12 utilised by the apparatus will be reduced by half, assuming that the web 12 is advanced after the print head assembly 11 has relatively traversed the web 12 for the second time.

Again, the method of the invention may cause the print head assembly 11 to traverse or otherwise move relative to the carrier for more than two times, provided that for each such movement during printing, no printing element is operated in the same pixel position between the start and end of printing positions, that the printing element was operated in a previous printing movement of the print head 11 relative to the same area of the web 12.

However, during the final printing operation using a particular area of carrier all the printing elements may be used in all possible pixel positions to ensure that an adequate amount of ink is transferred onto the fresh substrate in the event of any slight misalignment between the web 12 and the printing elements.

Various modifications may be made to the apparatus described with reference to the drawings, as follows.

The printing apparatus 10 may be used in other orientations to that described, as appropriate to the position and orientation of the substrate.

For example, although the printing apparatus 10 described has been of the type which utilises a web 12 carrying ink which is deposited by means of thermal printing elements onto a substrate, the invention may be applied to any other printing apparatus having a plurality of selectively operable printing elements to effect printing, such as a 24 dot matrix printer. The print head assembly 11 may incorporate an array-being a single line of printing elements as described, or an array being a matrix i.e. multiple lines of such elements.

Although in the arrangement described, the print head assembly 11 is carried via the mounting structures T by three drive belts 23,24,41, in another arrangement, less than three drive belts, or more than three drive belts, may be provided.

In place of drive belts, any other suitable endless loop members, such as chains, could be used to provide a transmission and mounting for the print head assembly 11, or indeed any other suitable flexible or rigid drive member or members which is/are able to provide drive to, and a means of mounting the print head assembly 11, could be used.

Although it is preferred for single stepper motor 21 to be used as a motive means for the printing apparatus 10, with suitable logic control e.g. utilising a computer, if desired more than one stepper motor 21 or other motive means may be provided. For example a separate motor may be provided to drive the drive roller R and take up spool 20 for the web 12.

Any alternative means to the piston and cylinder arrangement 50 for effecting movement of the print head assembly 11 towards the substrate, may be provided.

Although the invention has been described with reference to an apparatus in which the print head assembly 11 moves relative to the carrier of print medium i.e. web 12, and substrate during printing, the invention may be applied to an apparatus of the type in which the print head is at a fixed position, and the carrier carrying print medium, and the substrate are together moved relative to the print head during printing. In such an embodiment, rather than a print head assembly moving back to a start position of an area of the carrier in order relatively to traverse or otherwise move relative to the carrier a second time, the carrier may be arranged to be moved back relative to the print head assembly whilst fresh substrate is presented adjacent that area of the carrier, and the carrier and fresh substrate is traversed past the fixed print head assembly a second, and where appropriate, further, times.

Figure 4:
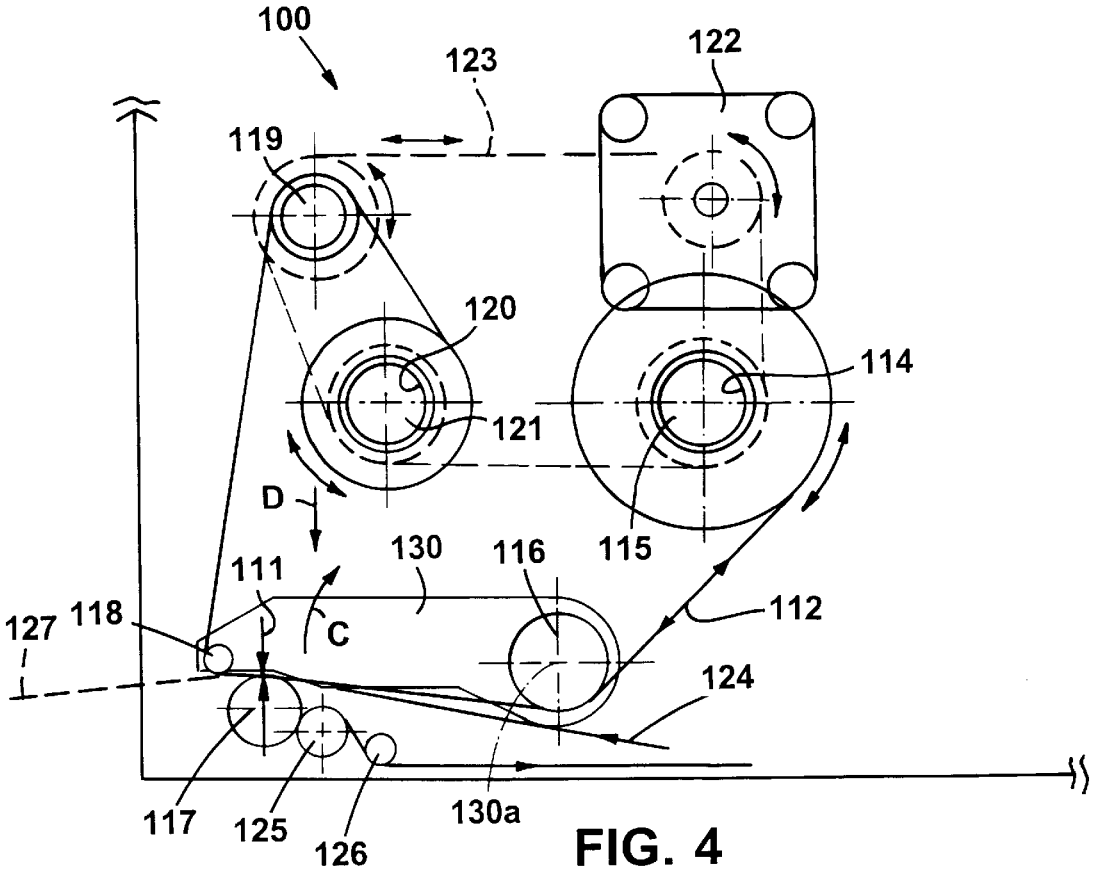
FIG. 4 is a plan view of part of an alternative embodiment of a printing apparatus in accordance with the invention.

Referring now to FIG. 4, a partial view of one embodiment of such an apparatus 100 shows web path and drive components. A web 112 carrying the ink is provided on a supply spool 114 carried on a hub 115, the web 112 passing around a web guide path comprising guide roller 116, print head roller 117 against which the print head 111 exerts a force during printing, guide roller 118, web drive roller 119, which is operable to drive the web 112 and is solely responsible for the amount of web 112 movement in either direction, as hereinafter explained. The web is then guided on to a take-up spool 120 carried on a hub 121. Supply spool 114, web drive roller 119, and take-up spool 120 are driven from a single motive means 122, which in this example is a two-way stepper motor, via a drive and timing belt 123. Spool 114 is driven through a one-way clutch and slip clutch and spool 120 is driven through a one way clutch and slip clutch, the one way clutches operating in tandem such that the two clutches are operable so that when the stepper motor 122 is operated so as to move the timing belt 122 in a clockwise direction as seen in FIG. 4, the take up spool 120 is driven, whilst spool 114 is not driven. Thus web 112 may be paid out from the supply spool 114 and taken up onto spool 120. Conversely, if stepper motor 122 is operated so as to move the timing belt 123 in an anti-clockwise direction as seen in FIG. 4, the supply spool 114 is driven so as to rotate anticlockwise and take-up web 112 onto it, whilst spool 120 is not driven and web 112 can be paid out from spool 120 for a purpose hereinafter described.

Additionally, slip clutches are provided for each of these spools 114 and 120 to accommodate differential movement between the spools 114 and 120 as increasingly, web is fed out from the supply spool 114 onto the take-up spool 120. The slip clutches also provide slight resistance (drag) when the respective spools 114,120, are paying out web 112.

If desired, at least the one-way clutches may be electrically operated, although simple mechanical devices are adequate to perform this function.

A substrate 124 is supplied from a supply spool (not shown) and passes between the web 112 and print head roller 117. Particularly if the substrate 124 consists of labels on a web, the path can continue around the print head drive roller 117, around a nip roller 125 and a guide roller 126. If the substrate is of another form such as polythene film, the path may continue in substantially the same direction, as indicated by chain line 127. The substrate 124 is driven by a second motive means (not shown) so that the substrate 124 moves in synchronism with the web 112 past the print head assembly which is indicated by arrow 111.

Movement of the substrate may be continuous or intermittent as desired.

During printing, the stepper motor 122 drives the timing belt 123 in a clockwise direction, the one-way clutch and slip clutch of spool 114 offers only slip/drag resistance to clockwise rotation and spool 114 acts as a supply spool. At the same time, the one way clutch and slip clutch of spool 120 allow spool 120 to be driven with web drive roller 119 in a clockwise direction so that the web 112 is taken up on to spool 120. By virtue of the slip clutch on the take-up spool 120, the actual amount of web 112 which traverses the print head 111, is governed entirely by the web drive roller 119 which is directly driven via belt 123 from the motor 122, and preferably comprises a rubber coated roller which gives good stiction with the web 112.

After completion of the first printing operation using an area of web 112, the print head assembly 111 is pulled back a small distance, in the order of half to one millimeter, from the web 112 in the direction of arrow C, thus releasing the pressure exerted on roller 117 during printing. This is achieved as the print head assembly 111 is mounted on an arm 130 which is rotatable about axis 130*a* of idler roller 16. The arm 130 is spring biased by a spring wound about the central axis 130 of idler roller 116, or otherwise, to urge the arm 130 away from the reaction roller 117.

The arm 130 and hence the print head 111, can be moved against the force of that spring by a pneumatically operated actuator which acts on the arm 130 in the direction of arrow D. Other suitable arrangements are no doubt possible.

The substrate 124 is then driven on so that an area of fresh substrate is provided adjacent to the print head 111. At the same time, the stepper motor 122 drives the timing belt 123 in an anticlockwise direction, the one way and slip clutches of spool 120 offering only slip/drag resistance to web 112 being paid out from spool 120 so that spool 120 acts as a supply spool whilst the one-way and slip clutches of spool 114 causes the spool 114 to be driven so that spool 114 acts as a pick-up spool. However, the amount of web 112 driven is again governed by the web drive roller 119. By this means, the same area of web 112 from which pixels of ink were removed during the previous printing operation can be aligned with the print head 111 and fresh substrate in preparation for a second printing operation.

This process may be repeated as often as required for an area of web 112. When that area of web 112 has been fully used, the web 112 is not wound back as the substrate 114 is wound on, but a first printing operation is carried out using a fresh area of web 112.

The operation of the two-way stepper motor 122 and the second stepper motor which drives the substrate 124, must be accurately co-ordinated. This may be achieved by mechanical means but is most conveniently provided by means of computer control. Alternatively, the stepper motor 122 may be arranged to drive the substrate.

In each case, the print head assembly 112, where the printing elements are energised thermally to transfer pixels of print medium i.e. ink from the carrier web 112 onto the substrate, control is preferably achieved by a computer, together with the relative movements of the print head and/or carrier and/or substrate as appropriate to cause either selective printing elements to be energised during each print operation, or for all or substantially all of the printing elements to be used during each printing operation but the printing elements are only energised in selected pixel positions during each printing operation to enable the same area of web 112 or other carrier respectively to be used to print information, by a method as described in detail above with reference to the embodiment of FIGS. 1 to 3.

The mechanism of FIG. 4, although ideal for performing a method of the first aspect of the invention, may be used in other apparatus where it is desired to move carrier in an appropriate direction to the direction the carrier and substrate move during printing.

I claim:

1. A method of thermal printing, comprising:

printing the same image on a series of substrates by making multiple passes of a print head which includes an array of energizeable thermal elements over an area of an ink carrier ribbon, said image being printed in a first pass by energizing a first set of said thermal elements, comprising alternate elements in said array, and without substantially advancing said carrier ribbon, said image being printed in a second pass by energizing a second set of thermal elements utilizing regions of the area of the ink carrier ribbon not utilized in said first pass.

2. The method of claim 1 wherein said second set of printing elements comprises a subset of thermal elements different than those used in the first pass.

3. The method of claim 1 comprising printing said information in a third pass by energizing substantially all of said thermal elements.

4. The method of claim 1 wherein said second set of thermal elements comprises substantially all of said thermal elements.

5. The method of claim 1 wherein said print head is passed over said carrier by moving the print head relative to the carrier ribbon.

6. The method of claim 1 wherein said image is a sell-by date.

7. The method of claim 6 comprising moving said carrier after said second pass to position fresh carrier adjacent said print head and repeating said first pass and said second pass.

8. The method of claim 7 comprising moving said substrate after each pass to provide fresh substrate adjacent said ink carrier.

9. The method of claim 1 or 8 wherein said thermal elements are in a single-line array.

10. The method of claim 1 wherein said thermal elements are in a multiple-line array.

11. The method of claim 1 wherein said print head is passed over said carrier by moving carrier ribbon relative to the print head.

12. The method of claim 1 wherein said carrier ribbon is controlled by a computer.

13. The method of claim 1 wherein said print head is controlled by a computer.

14. A method of thermal printing, comprising:

printing the same image on a series of substrates by making multiple passes of a print head that has an array of energizeable thermal elements over an area of an ink carrier ribbon, wherein said image is printed in a first pass by energizing a first set of said thermal elements comprising less than all of the thermal elements across the image, and without substantial advancing said carrier ribbon, printing said image in a second pass by energizing a second set of thermal elements utilizing regions of the area of the ink carrier ribbon not utilized in said first pass.

15. The method of claim 14 wherein said second set of thermal elements comprises substantially all of said thermal elements.

16. The method of claim 14 or 15 wherein said thermal elements are in a single-line array.

17. A method of printing with a thermal printer comprising a print head with an array of heating elements individually selectable by a computer controller, and a print carrier carrying a layer of thermally sensitive print medium, pixels of the thermally sensitive print medium being in use deposited on a print area of a substrate, by energizing heating elements, the printer being capable of printing an image at a maximum print density determined by the number of heating elements in the array and the number of pixel row positions along the image at which the heating elements are individually selected and energized, the method comprising printing an image on a substrate utilizing a first set of the heating elements by individually selectively energizing heating elements of the first set only in each of the pixel row positions, so that print medium from an area of the carrier is deposited onto the substrate, the resultant image being of a print density less than the maximum print density, printing a second image on fresh substrate using a second set of the heating elements, by individually selectively energizing heating elements of the second set only in each of the pixel row positions, so that print medium from the same area of the carrier is deposited onto the substrate, the resultant second image being of a print density less than the maximum print density.

18. A method according to claim 17 wherein the second set of printing elements which are used to print the image on the fresh substrate comprises all of the heating elements.

19. A method according to claim 17 wherein during the first printing operation in which the first set only of the heating elements are used, the print head, and the carrier and substrate, are relatively moved so that the individually selected printing elements of the first set are energized in each of the pixel row positions along the image, and in a subsequent printing operation in which the second set of the heating elements are used, the print head, and the carrier and substrate are relatively moved so that the individually selected printing elements of the second set are energized in each of the pixel row positions along the image.

20. A method according to claim 19 wherein after the first printing operation in which an image is printed, the print head and carrier are relatively moved to replace the print head at a start of print position, and the carrier and substrate are relatively moved such that the fresh substrate is presented adjacent to the area of carrier from which pixels of print medium were removed in the first printing operation.

21. A method according to claim 19 wherein the relative movement between the print head, and substrate and carrier, is produced by moving the print head whilst the substrate and carrier is held stationary.

22. A method according to claim 19 wherein the relative movement between the print head, and substrate carrier, is produced by moving the substrate and carrier whilst the print head is held stationary.

23. A method according to claim 17 wherein the heating elements are arranged in a single line array.

24. A method according to claim 17 wherein the heating elements are arranged in a non-single line array.

25. A method of printing with a thermal printer comprising a print head with an array of heating elements individually selectable by a computer controller, and a print carrier carrying a layer of thermally sensitive print medium, pixels of the thermally sensitive print medium being in use deposited on a print area of a substrate, by energizing heating elements, the printer being capable of printing an image at a maximum print density determined by the number of heating elements in the array and the number of pixel row positions along the image at which the heating elements are individually selected and energized, the method comprising printing an image on a substrate utilizing the heating elements by individually selectively energizing the heating elements only in a first set of pixel row positions along the image, so that print medium from an area of the carrier is deposited onto the substrate, the resultant image being of a print density less than the maximum print density, printing a second image on fresh substrate using the heating elements by individually selectively energizing heating elements in a second set of pixel row positions along the image, so that print medium from the area of the carrier is deposited onto the fresh substrate, the resultant second image being of a print density less than the maximum print density.

26. A method according to claim 25 wherein the second set of pixel row positions along the image comprise all of the pixel row positions at which the heating elements are individually selectable.

27. A method according to claim 25 wherein during a first printing operation in which the heating elements are individually selectively energized in the first set of pixel row positions only along the image, the print head, and the carrier and substrate, are relatively moved, and in a subsequent printing operation in which the heating elements are individually selectively energized in the second set of pixel row positions along the image, the print head, and the carrier and substrate are relatively moved.

28. A method according to claim 27 wherein after the first printing operation in which an image is printed, the print head and carrier are relatively moved to replace the print head at a start of print position, and the carrier and substrate are relatively moved such that the fresh substrate is presented adjacent to the area of carrier from which pixels of print medium were removed in the first printing operation.

29. A method according to claim 27 wherein the relative movement between the print head, and substrate and carrier, is produced by moving the print head whilst the substrate and carrier is held stationary.

30. A method according to claim 27 wherein the relative movement between the print head, and substrate and carrier, is produced by moving the substrate and carrier whilst the print head is held stationary.

31. A method according to claim 25 wherein the heating elements are arranged in a single line array.

32. A method according to claim 25 wherein the heating elements are arranged in a non-single line array.

33. A method of thermal printing, comprising:

printing the same image on a series of substrates by making multiple passes of a print head which includes a single line array of energizeable thermal elements over an area of an ink carrier ribbon by moving the print head relative to said carrier ribbon, said image being printed in a first pass by energizing a first set of said thermal elements, comprising alternate elements in said array, and without substantially advancing said carrier ribbon, said image being printed in a second pass by energizing a second set of thermal elements, utilizing regions of the area of the ink carrier ribbon not utilized in said first pass, said second set comprising substantially all of said thermal elements.

34. A method of thermal printing, comprising:

printing the same image on a series of substrates by making multiple passes of a print head that has a single line array of energizeable thermal elements over an area of an ink carrier ribbon, wherein said image is printed in a first pass by energizing a first set of said thermal elements comprising less than all of the thermal elements across the image, and without substantially advancing said carrier ribbon, printing said image in a second pass by energizing a second set of thermal elements, utilizing regions of the area of the ink carrier ribbon not utilized in said first pass, said second set comprising substantially all of said thermal elements.

35. A method of printing with a thermal printer comprising a print head with a single line array of heating elements individually selectable by a computer controller, and a print carrier carrying a layer of thermally sensitive print medium, pixels of the thermally sensitive print medium being in use deposited on a print area of a substrate, by energizing heating elements, the printer being capable of printing an image at a maximum print density determined by the number of heating elements in the array and the number of pixel row positions along the image at which the heating elements are individually selected and energized, the method comprising printing an image on a substrate utilizing a first set of the heating elements by individually selectively energizing heating elements of the first set only in each of the pixel row positions, so that print medium from an area of the carrier is deposited onto the substrate, the resultant image being of a print density less than the maximum print density, printing a second image on fresh substrate using a second set of the heating elements, by individually selectively energizing heating elements of the second set only in each of the pixel row positions, so that print medium from the same area of the carrier is deposited onto the substrate, the resultant second image being of a print density less than the maximum print density, wherein the second set of printing elements which are used to print the image on the fresh substrate comprises all of the heating elements.

36. A method of printing with a thermal printer comprising a print head with a single line array of heating elements individually selectable by a computer controller, and a print carrier carrying a layer of thermally sensitive print medium, pixels of the thermally sensitive print medium being in use deposited on a print area of a substrate, by energizing heating elements, the printer being capable of printing an image at a maximum print density determined by the number of heating elements in the array and the number of pixel row positions along the image at which the heating elements are individually selected and energized, the method comprising printing an image on a substrate utilizing the heating elements by individually selectively energizing the heating elements only in a first set of pixel row positions along the image, so that print medium from an area of the carrier is deposited onto the substrate, the resultant image being of a print density less than the maximum print density, printing a second image on fresh substrate using the heating elements by individually selectively energizing heating elements in a second set of pixel row positions along the image, so that print medium from the area of the carrier is deposited onto the fresh substrate, the resultant second image being of a print density less than the maximum print density wherein the second set of pixel row positions along the image comprise all of the pixel row positions at which the heating elements are individually selectable.

* * * * *